US010031445B2

(12) United States Patent
Kojima

(10) Patent No.: US 10,031,445 B2
(45) Date of Patent: Jul. 24, 2018

(54) IMAGE FORMING APPARATUS WITH VOLTAGE CONTROL TO SUPPRESS TRANSFER OF ADJUSTING TONER IMAGE

(71) Applicant: CANON KABUSHIKI KAISHA, Tokyo (JP)

(72) Inventor: Etsuji Kojima, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/000,310

(22) Filed: Jan. 19, 2016

(65) Prior Publication Data

US 2016/0209786 A1 Jul. 21, 2016

(30) Foreign Application Priority Data

Jan. 20, 2015 (JP) ..... 2015-008656

(51) Int. Cl.
*G03G 15/00* (2006.01)
*G03G 15/16* (2006.01)

(52) U.S. Cl.
CPC ..... *G03G 15/1605* (2013.01); *G03G 15/1675* (2013.01); *G03G 15/5058* (2013.01); *G03G 2215/00569* (2013.01)

(58) Field of Classification Search
CPC ..... G03G 15/1675; G03G 15/168; G03G 15/556; G03G 2215/00059
USPC ..... 399/66, 71
See application file for complete search history.

(56) References Cited

U.S. PATENT DOCUMENTS 6,173,135 B1 1/2001 Yuminamochi et al.
7,486,918 B2 2/2009 Kojima
8,369,757 B2 2/2013 Kojima
8,958,708 B2 2/2015 Kojima
(Continued)

FOREIGN PATENT DOCUMENTS

JP 2000029281 A 1/2000
JP 2000147915 A 5/2000
(Continued)

OTHER PUBLICATIONS

U.S. Appl. No. 14/819,926, Etsuji Kojima, filed Aug. 6, 2015.
(Continued)

*Primary Examiner* — Walter L Lindsay, Jr.
*Assistant Examiner* — Arlene Heredia Ocasio
(74) *Attorney, Agent, or Firm* — Fitzpatrick, Cella, Harper & Scinto

(57) ABSTRACT

An image forming apparatus includes a movable endless belt, a toner image forming unit, a movable transfer member, a voltage source, a setting portion. When a maximum cumulative value in a case where a length in which an adjusting toner image is formed with respect to a movement direction of the belt at a plurality position with respect to a widthwise direction of the belt perpendicular to the movement direction is accumulated is defined as a representative cumulative value, the setting portion sets the second voltage when the adjusting toner image passing through the transfer portion is a first adjusting toner image so as to be lower than the second voltage when the adjusting toner image passing through the transfer portion is a second adjusting toner image smaller in representative cumulative value than the first adjusting toner image.

14 Claims, 5 Drawing Sheets

(56) References Cited

U.S. PATENT DOCUMENTS

| | | | | |
|---|---|---|---|---|
| 9,026,017 | B2 * | 5/2015 | Sakamoto | G03G 15/0131 399/301 |
| 9,037,021 | B2 * | 5/2015 | Yamaura | G03G 15/168 399/101 |
| 9,098,020 | B2 | 8/2015 | Aiba | |
| 2011/0222128 | A1 * | 9/2011 | Wada | G03G 15/0131 358/3.27 |
| 2012/0063795 | A1 * | 3/2012 | Funatani | G03G 15/0189 399/44 |
| 2013/0051832 | A1 * | 2/2013 | Aiba | G03G 15/0189 399/71 |
| 2013/0156450 | A1 * | 6/2013 | Hano | G03G 15/5041 399/49 |
| 2013/0287417 | A1 * | 10/2013 | Saito | G03G 15/1675 399/49 |
| 2015/0147074 | A1 * | 5/2015 | Wada | G03G 15/161 399/21 |

FOREIGN PATENT DOCUMENTS

| | | | |
|---|---|---|---|
| JP | 2006215369 | A | 8/2006 |
| JP | 2013045057 | A | 3/2013 |

OTHER PUBLICATIONS

U.S. Appl. No. 14/840,564, Etsuji Kojima, filed Aug. 31, 2015.
U.S. Appl. No. 14/851,124, Etsuji Kojima, filed Sep. 11, 2015.
U.S. Appl. No. 14/976,568, Etsuji Kojima, filed Dec. 21, 2015.

* cited by examiner

IMAGE FORMING APPARATUS WITH VOLTAGE CONTROL TO SUPPRESS TRANSFER OF ADJUSTING TONER IMAGE

FIELD OF THE INVENTION AND RELATED ART

The present invention relates to an image forming apparatus, using a toner, such as a printer, a copying machine or a facsimile machine.

An image forming apparatus in which a toner image is transferred onto a recording material using a transfer portion where a transfer roller is contacted to an intermediary transfer belt has been widely used.

In the image forming apparatus, as described later, for the purposes of toner image density adjustment, toner image positioning, discharge of a deteriorated toner, and the like, the toner image which is intended to be not transferred onto the recording material is formed in some cases. The toner image which is intended to be not transferred onto the recording material is transferred onto the intermediary transfer belt and is subjected to necessary measurement or the like, and then is passed through a transfer portion in a state in which there is no recording material, so that the toner image is removed by a cleaning device provided adjacent to the intermediary transfer belt.

The toner image which is intended to be not transferred onto the recording material passes through the transfer portion in the state in which there is no recording material, and therefore even when a transfer voltage is not applied, a toner deposits on the transfer roller in a consideration amount. For this reason, when the toner image which was intended to be not formed on the recording material passed through the transfer portion, transfer of the toner onto the transfer roller was suppressed by applying a voltage of the same polarity as a charge polarity of the toner to the transfer roller.

Japanese Laid-Open Patent Application 2000-29281 discloses that a so-called "back surface contamination" that when the toner carried on the intermediary transfer belt is transferred onto the transfer roller, the toner is deposited on a back surface of the recording material contacted to the transfer roller generates. In order to avoid the back surface contamination, during post rotation after image formation, positive and negative voltages are alternately applied to the transfer roller to effect electrical cleaning, whereby the toner deposited on the transfer roller is returned to the intermediary transfer belt.

In the case where the toner image which is intended to be not transferred onto the recording material, when a voltage which has an opposite polarity to a charge polarity of the toner and which has a large absolute value is applied to the transfer roller, a toner charge amount distribution of the toner image passing through the transfer portion broadens, so that the toner having a low toner charge amount increases. The toner having the low toner charge amount has a weak depositing force onto the intermediary transfer belt, and therefore is liable to scatter at a downstream of the transfer portion. The toner scattered at the downstream of the transfer portion deposits on a leading end portion surface of a subsequent recording material subjected to the image formation, and thus generates a so-called "end portion contamination".

SUMMARY OF THE INVENTION

According to an aspect of the present invention, there is provided an image forming apparatus comprising: a movable endless belt; a toner image forming unit for forming, on the belt, toner images including a toner image for an image which is transferred onto a recording material and an adjusting toner image which is not transferred onto the recording material; a movable transfer member for transferring the toner image at a transfer portion from the belt onto the recording material which is fed; a voltage source for applying a voltage to the transfer member; and a setting portion for setting the voltage applied to the transfer member in a period in which the toner image for the image passes through the transfer portion at a first voltage and for setting the voltage applied to the transfer member in a period in which the adjusting toner image passes through the transfer portion at a second voltage of an opposite polarity to a polarity of the first voltage, wherein when a maximum cumulative value in a case where a length in which the adjusting toner image is formed with respect to a movement direction of the belt at a plurality of positions with respect to a widthwise direction of the belt perpendicular to the movement direction is accumulated is defined as a representative cumulative value, the setting portion sets the second voltage when the adjusting toner image passing through the transfer portion is a first adjusting toner image so as to be lower than the second voltage when the adjusting toner image passing through the transfer portion is a second adjusting toner image smaller in representative cumulative value than the first adjusting toner image.

Further features of the present invention will become apparent from the following description of exemplary embodiments with reference to the attached drawings.

DESCRIPTION OF THE PREFERRED EMBODIMENTS

Hereinbelow, embodiments of the present invention will be described in detail with reference to the drawings.

Embodiment 1

(Image Forming Apparatus)

Figure 1:
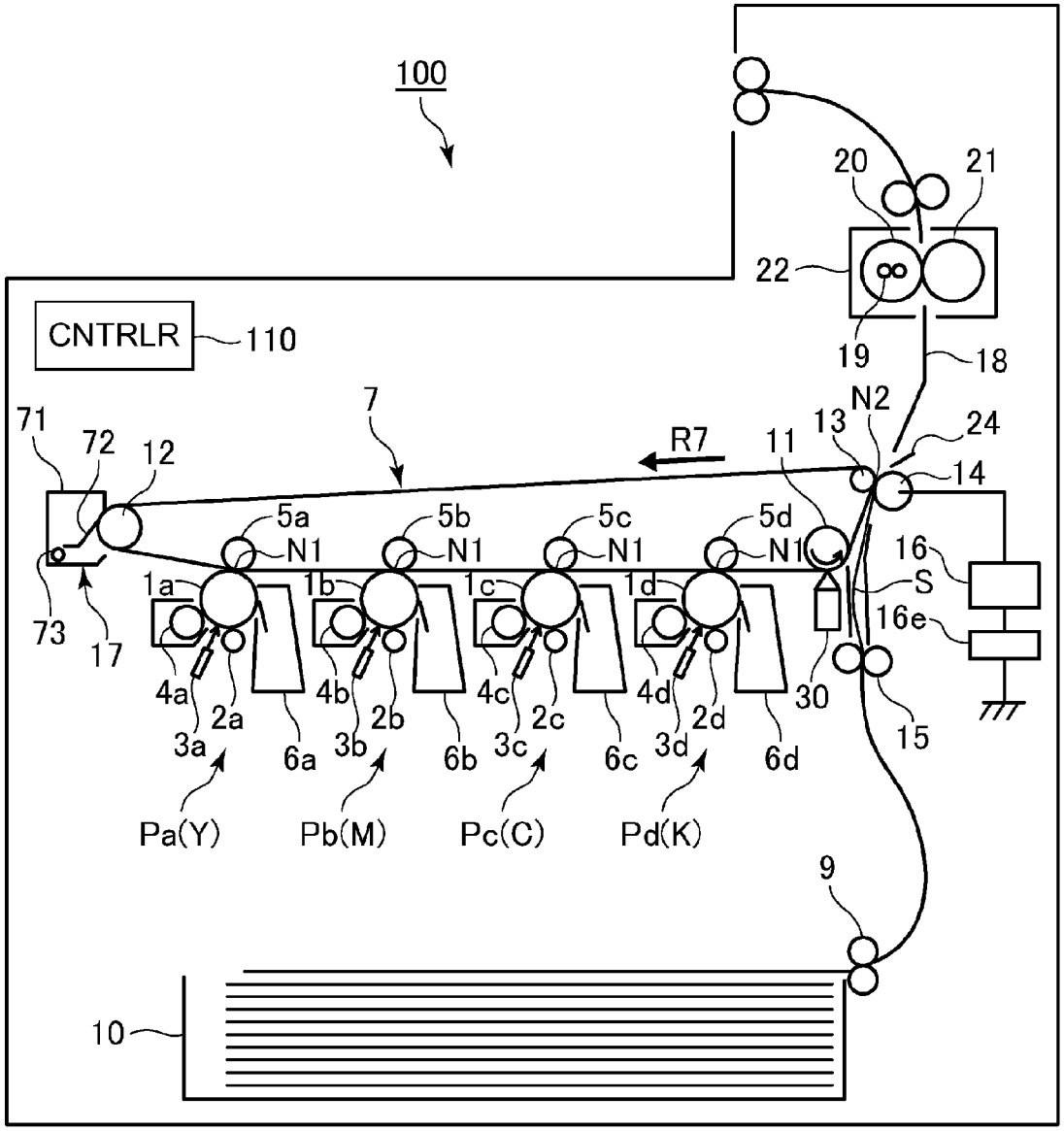
FIG. 1 is an illustration of a structure of an image forming apparatus.

FIG. 1 is an illustration of a structure of an image forming apparatus. As shown in FIG. 1, an image forming apparatus 100 in this embodiment is a tandem and intermediary transfer type image forming apparatus in which image forming portions Pa, Pb, Pc, Pd are arranged along a lower surface of an intermediary transfer belt 7.

At the image forming portion Pa, a yellow toner image is formed on a photosensitive drum 1*a* and then is primary-transferred onto the intermediary transfer belt 7. At the image forming portion Pb, a magenta toner image is formed on a photosensitive drum 1*b* and is primary-transferred onto the intermediary transfer belt 7. At the image forming portions Pc and Pd, a cyan toner image and a black toner image are formed on photosensitive drums 1*c* and 1*d*, respectively, and are successively primary-transferred onto the intermediary transfer belt 7. The four color toner images transferred superposedly on the intermediary transfer belt 7 are collectively secondary-transferred onto a recording material S at a secondary transfer portion N2.

The recording material S is stacked on a cassette 10 and is separated one by one after being pulled out from the cassette 10 and then is on standby at a registration roller pair 15. The registration roller pair 15 sends the recording material S to the secondary transfer portion N2 by being timed to the toner images on the intermediary transfer belt 7.

The recording material S on which the toner images are transferred is fed to a fixing device 22. The fixing device 22 includes a fixing roller 20 including a heater 19 and a pressing roller between which a nip is formed and the recording material S is sandwiched and heat-pressed, so that the image is fixed on the recording material S.

(Image Forming Portion)

Figure 2:
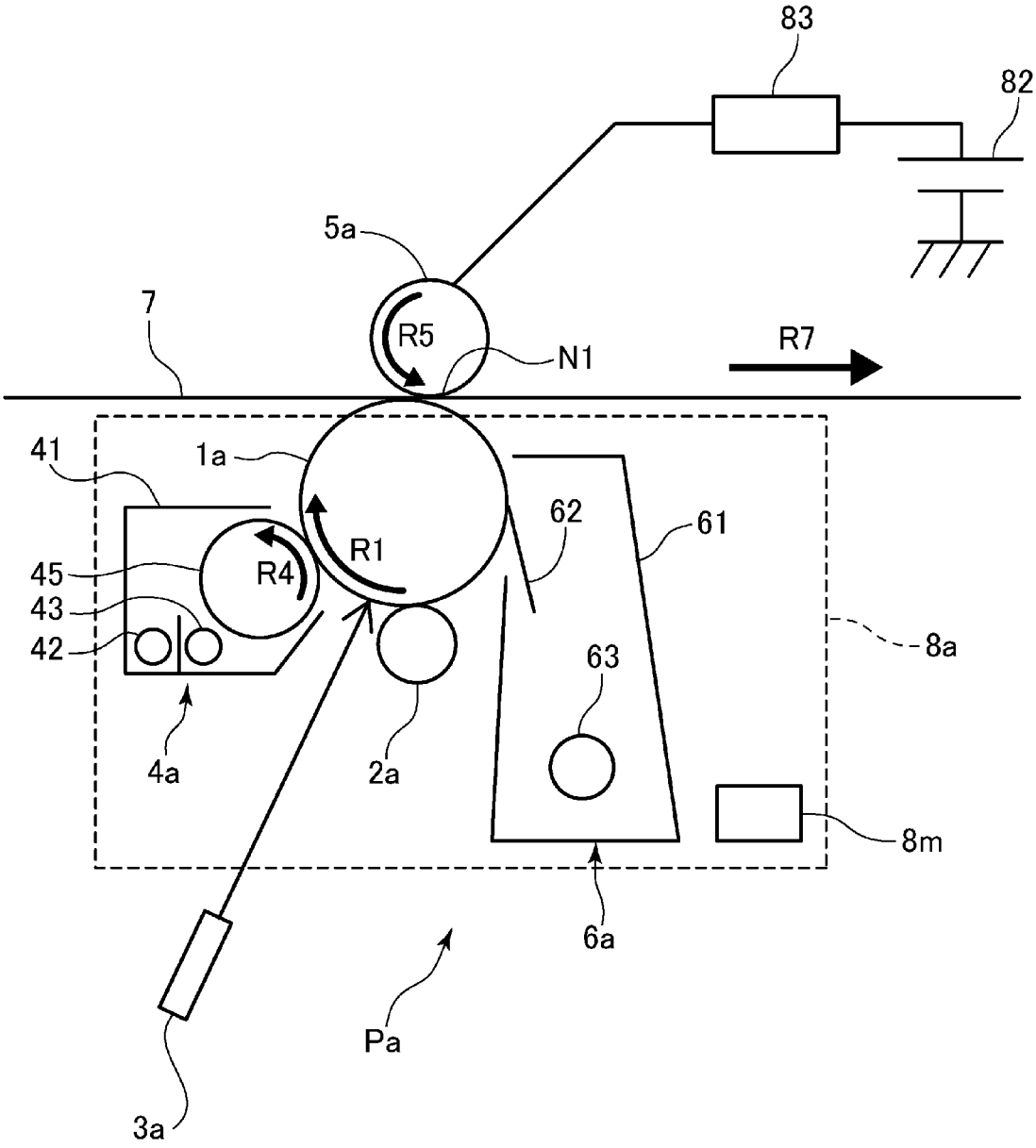
FIG. 2 is an illustration of a structure of an image forming portion.

FIG. 2 is an illustration of a structure of the image forming portion.

The image forming portions Pa, Pb, Pc, Pd have the substantially same constitution except that the colors of toners used in developing devices 4*a*, 4*b*, 4*c*, 4*d* are different from each other, and therefore in the following description, the image forming portion Pa will be described and other image forming portions Pb, Pc, Pd will be omitted from redundant description.

As shown in FIG. 2, the image forming portion Pa includes the photosensitive drum 1*a*, and around the photosensitive drum 1*a*, a charging roller 1*a*, an exposure device 3*a*, the developing device 4*a*, a transfer roller 5*a*, and a drum cleaning device 6*a* are disposed. The photosensitive drum 1*a*, the charging roller 2*a*, the developing device 4*a* and the drum cleaning device 6*a* are assembled into a process cartridge 8*a* detachably mountable to an apparatus main assembly of the image forming apparatus 100.

The photosensitive drum 1*a* is constituted by an aluminum cylinder on which a photosensitive layer is formed at an outer peripheral surface and is rotated in an arrow R1 direction at a process speed of 100 mm/sec.

To the charging roller 2*a*, an oscillating voltage in the form of a DC voltage VD biased with an AC voltage is applied, so that the surface of the photosensitive drum 1*a* is electrically charged uniformly to a negative potential VD.

The exposure device 3*a* scans the surface of the photosensitive drum 1*a* with a laser beam subjected to ON/OFF modulation of a scanning signal obtained by developing a yellow component image along a scanning line, and an absolute value of an exposed portion potential is lowered, so that an electrostatic image, for an image, having a negative potential VL is formed. The developing device 4*a* supplies the toner to the photosensitive drum 1*a* and develops the electrostatic image into the toner image.

To the primary transfer roller 5*a*, a positive DC voltage is applied from a voltage source 82, so that the toner image on the photosensitive drum 1*a* passing through the primary transfer portion N1 is primary-transferred onto the intermediary transfer belt 7.

The drum cleaning device 6*a* rubs the photosensitive drum 1*a* with a cleaning blade 62 to collect the toner which passes through the primary transfer portion N1 and which remains on the photosensitive drum 1*a*. The toner falling in a cleaning container 61 is collected at one end portion of the cleaning container 61 by a feeding screw 63 and then is discharged into an unshown toner collecting container 61.

(Developing Device)

The developing device 4*a* is filled with a developer (two-component developer) containing the toner and a magnetic carrier. In a developing chamber 41, the developer is circulated while being stirred by feeding screws 42, 43, so that the toner is negatively charged and the magnetic carrier is positively charged.

A developing sleeve 45 carries the charged two-component developer and rotates in an arrow R4 direction. The two-component developer forms an erected magnetic chain at an opposing portion to the photosensitive drum 1*a* by a magnetic field of an unshown magnet disposed in the developing sleeve 45, and rubs the photosensitive drum 1*a*.

An unshown voltage source applies, to the developing sleeve 45, an oscillating voltage in the form of a DV voltage Vdc, between the potential VD and the potential VL, biased with an AC voltage, so that the toner carried by the magnetic chain is transferred onto the electrostatic image on the photosensitive drum 1*a*.

(Intermediary Transfer Belt)

The intermediary transfer belt 8 is extended around and supported by a driving roller 11, an outer secondary transfer roller 13 and a tension roller 12, and is driven by the driving roller 11 to be rotated in an arrow R7 direction. The intermediary transfer belt 7 is formed, in an endless belt shape, of a dielectric resin material such as PC (polycarbonate), PET (polyethylene terephthalate), PVDF (polyvinylidene fluoride), PI (polyimide) or PEEK (polyether ether ketone).

A belt cleaning device 17 rubs the intermediary transfer belt 7 with a cleaning blade 72, thus collecting the toner which passed through the secondary transfer portion N2 and which remains on the surface of the intermediary transfer belt 7.

A belt cleaning device 17 rubs the intermediary transfer belt 7 with a cleaning blade 72 to collect the toner which passes through the secondary transfer portion N2 and which remains on the intermediary transfer belt 7. The toner falling in a cleaning container 71 is collected at one end portion of the cleaning container 71 by a feeding screw 73 and then is discharged into an unshown toner collecting container 71.

(Secondary Transfer Portion)

Figure 3:
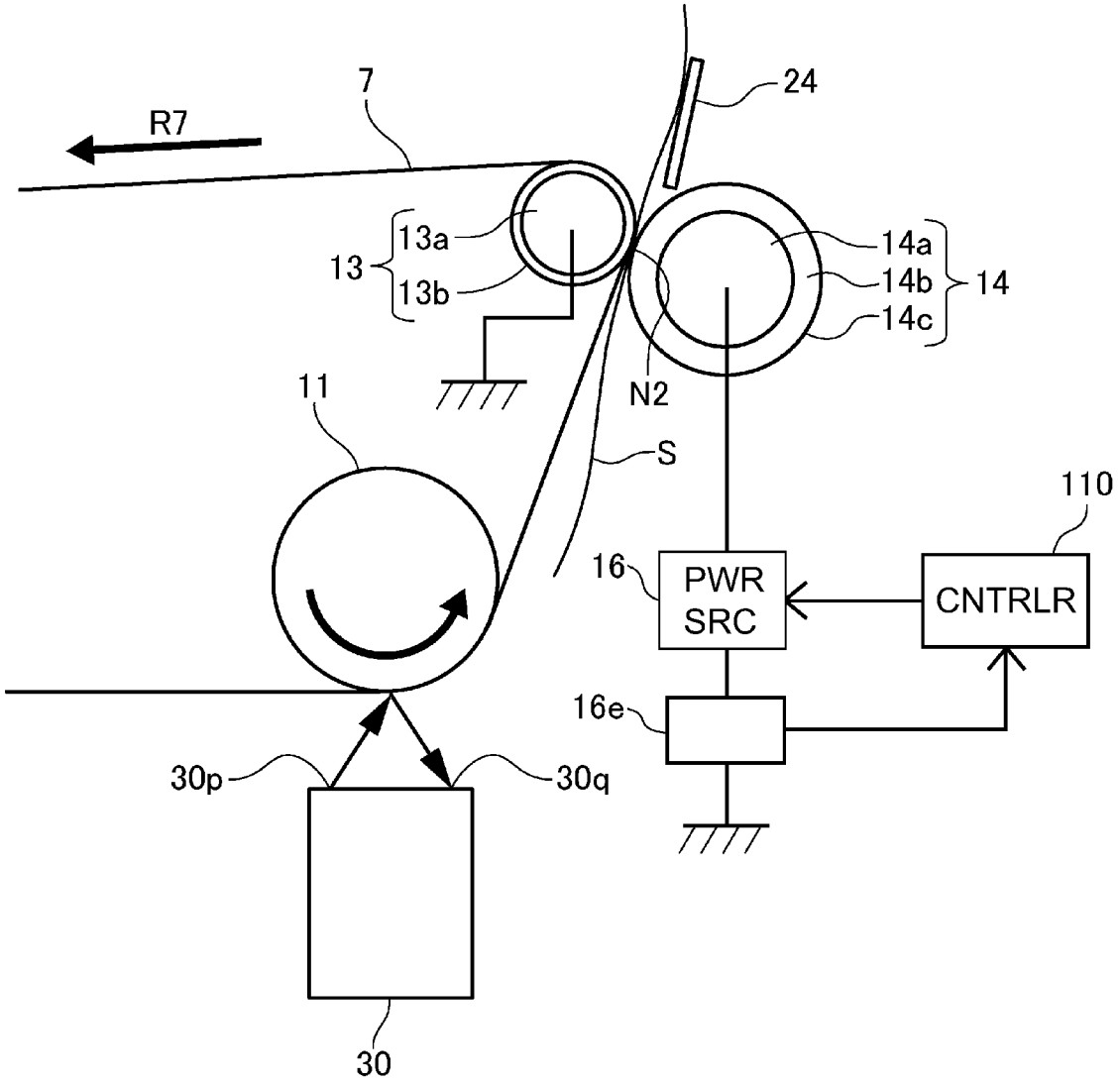
FIG. 3 is an illustration of a secondary transfer portion.

FIG. 3 is an illustration of a structure of the secondary transfer portion. The image forming apparatus 100 is of a roller transfer type using the transfer roller. In the roller transfer type, to the transfer roller contacted to the image bearing member, a transfer voltage is applied and a transfer electric field is formed between the image bearing member and the transfer roller, so that the toner image is transferred from the image bearing member onto the recording material or the like. In the roller transfer type, the recording material is nipped and fed at a nip formed between the image bearing member and the transfer roller. The roller transfer type is advantageous from the viewpoints of downsizing and simplification of the image forming apparatus and suppression of generation of ozone compared with a corona discharging type or the like.

As shown in FIG. 3, an outer secondary transfer roller 14 is contacted to the intermediary transfer belt 7 supported by the inner secondary transfer roller 13, so that the secondary transfer portion N2 is formed between the intermediary transfer belt 7 and the outer secondary transfer roller 14. The outer secondary transfer roller 14 sandwiches the intermediary transfer belt 7 between itself and the inner secondary transfer roller 13.

The inner secondary transfer roller 13 is prepared by forming a 0.5 mm-thick elastic layer 13*b* of an electroconductive rubber material on a peripheral surface of an aluminum cylinder 13*a* of 12 mm in diameter. The electroconductive rubber material for the elastic layer 13*b* is a neoprene rubber in which carbon black is disposed.

The outer secondary transfer roller 14 is prepared by forming a 2.0 mm-thick elastic layer 14*b* of an electroconductive rubber material on a peripheral surface of an aluminum cylinder 14*a* of 16 mm in diameter and by forming a parting layer 14*c* of a fluorine-containing resin material coated on the surface of the elastic layer 14*b*. The electroconductive rubber material for the elastic layer 14*b* is an ethylene-propylene-butadiene rubber in which an ion-conductive agent is contained. The fluorine-containing resin material for the parting layer 14*c* is polytetrafluoroethylene.

The voltage source (power source) 16 applies, to the outer secondary transfer roller 14, a transfer voltage Vt which is a DC voltage of a positive polarity opposite to the toner charge polarity when the recording material S passes through the secondary transfer portion N2 is a superposed state with the intermediary transfer belt 7 on which the toner images are carried. A current detecting circuit 16*e* detects a current flowing through the outer secondary transfer roller 14.

As described above, as shown in FIG. 1, each of the image forming portions Pa, Pb, Pc, Pd which is an example of a toner image forming means forms the toner image on the intermediary transfer belt 7 which is an example of the image bearing member. The outer secondary transfer roller 14 which is an example of a rotatable transfer member contacts the intermediary transfer belt 7, so that a transfer portion where the toner image is transferred from the intermediary transfer belt 7 onto the recording material S is formed.

A belt cleaning device 17 which is an example of a cleaning device is provided downstream of the secondary transfer portion N2 and upstream of the image forming portions Pa, Pb, Pc, Pd with respect to a rotational direction of the intermediary transfer belt 7, and removes the toner deposited on the intermediary transfer belt 7. A recording material guide 24 which is an example of a guiding member is provided downstream of the secondary transfer portion N2 with respect to a recording material feeding direction and guides the recording material S passing through the secondary transfer portion N2.

(Electrical Cleaning of Secondary Transfer Roller)

Figure 5:
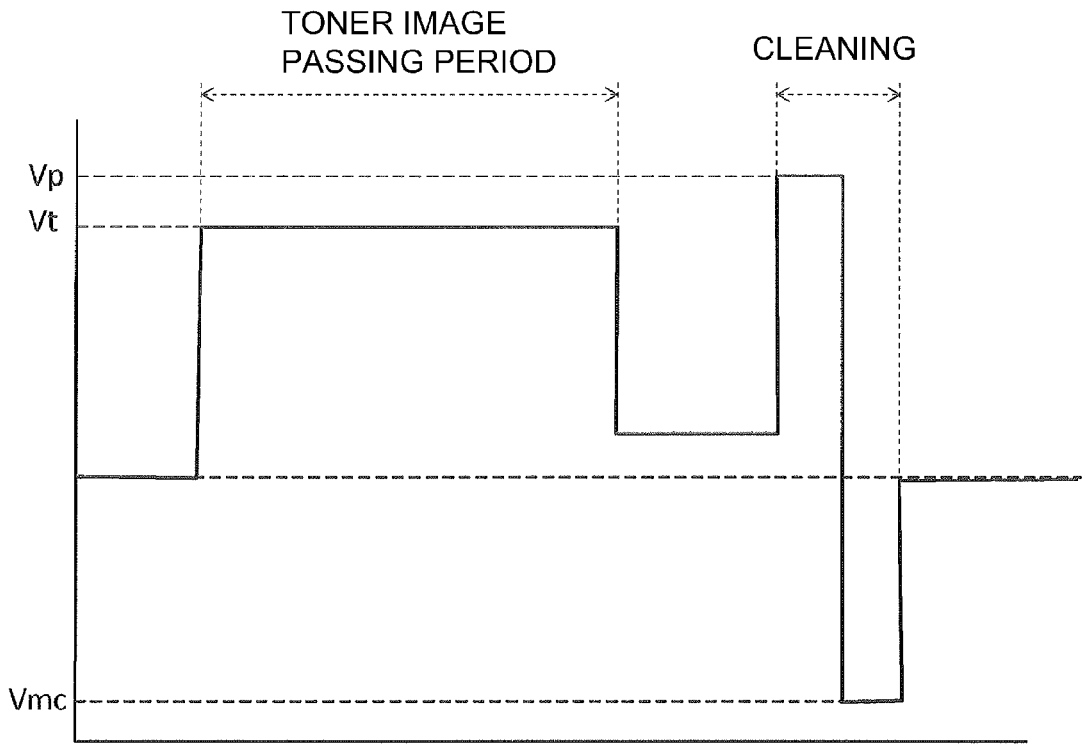
FIG. 5 is an illustration of voltage control of a toner image for an image.

FIG. 5 is an illustration of voltage control of the toner image for the image.

As shown in FIG. 3, when the toner image for the image passes through the secondary transfer portion N2, the positive transfer voltage is applied to the outer secondary transfer roller 14. However, the toner image for the image is pressed against the recording material S toward the outer secondary transfer roller 14, and therefore is not deposited on the outer secondary transfer roller 14.

However, the toner deposited on the intermediary transfer belt 7 between adjacent two recording materials S is deposited on the outer secondary transfer roller 14 to which the positive transfer voltage is applied. For this reason, the image formation is accumulated, the outer secondary transfer roller 14 is gradually contaminated.

Therefore, in a post-rotation executed after an end of a transfer step of the toner image for the image, cleaning voltages having the positive polarity and the negative polarity are applied to the outer secondary transfer roller 14, so that the toner deposited on the outer secondary transfer roller 14 is moved to the intermediary transfer belt 7. That is, as shown in FIG. 5, the voltage source 16 applies the transfer voltage Vt to the outer secondary transfer roller 14 during passing of the toner image for a final image of the image forming job through the secondary transfer portion N2, so that the toner image for the image is transferred onto the recording material S. At this time, on the outer secondary transfer roller 14, the toner charged to the normal polarity, the toner charged to the opposite polarity, the uncharged toner are deposited.

After the transfer of the toner image for the image is ended, the voltage source 16 outputs a cleaning voltage Vp of the opposite polarity to the toner charge polarity through one full turn or more of the outer secondary transfer roller 14. In this embodiment Vp=+1500 V. As a result, the polarity-inverted (positively charged) toner deposited on the outer secondary transfer roller 14 is transferred onto the intermediary transfer belt 7.

Then, the voltage source 16 outputs a cleaning voltage Vmc of the same polarity as the toner charge polarity through one full turn or more of the outer secondary transfer roller 14. In this embodiment Vmc=−1000 V. As a result, the normally charged (negatively charged) toner deposited on the outer secondary transfer roller 14 is transferred onto the intermediary transfer belt 7.

As a result, both of the normal charged toner and the polarity-inverted toner can be removed, so that a good cleaning property can be obtained and the outer secondary transfer roller 14 can be returned to a state in which no toner is deposited thereon.

As described above, the voltage source 16 which is an example of a voltage (power) source outputs the voltage so as to form an electric field at the secondary transfer portion N2. The controller 110 which is an example of a control executes an operation in a first mode when the toner image to be transferred onto the recording material is formed on the intermediary transfer belt 7 and passes through the secondary transfer portion N2. In the first mode, the controller 110 causes the voltage source 16 to output the voltage Vt which is an example of a first voltage, so that the toner image is transferred onto the recording material. Further, the controller 110 executes an operation in a second mode during the post-rotation which is an example of a time when the toner image does not pass through the secondary transfer portion N2. In the second mode, the controller 110 causes the voltage source 16 to output the voltage Vmc of the opposite polarity to the polarity of the first voltage through one full turn or move of the outer secondary transfer roller 14, so that the outer secondary transfer roller 14 is cleaned. When the toner image does not pass through the secondary transfer portion N2, the operation in the second mode may also be performed during pre-rotation before first image formation in the image forming job or an interval between toner images for the image to be transferred onto the recording material (i.e., so-called sheet (paper) interval).

(Cleaning Voltage)

The cleaning voltage Vmc of the same polarity as the toner charge polarity shown in FIG. 5 is determined by the following procedure. After the image forming job for effecting image formation of continuous 200 sheets, as shown in FIG. 5, electrical cleaning of the outer secondary transfer roller 14 was executed, so that the cleaning voltage Vmc was changed from 0 V to −1000 V at 6 levels. Then, the image formation was executed, and a back surface contamination level of an output image on the recording material was compared.

TABLE 1

| | Vmc (V) | | | | | |
|---|---|---|---|---|---|---|
| | 0 | −200 | −400 | −600 | −800 | −1000 |
| BSCL*[1] | X | X | X | Δ | ◎ | ◎ |

*[1]"BSCL" is the back surface contamination level.

As shown in Table 1, when an absolute value of the Vmc is 800 V or more, the back surface contamination of the recording material is at an OK level, so that a good cleaning effect is obtained.

(Adjusting Toner Image)

Figure 4:
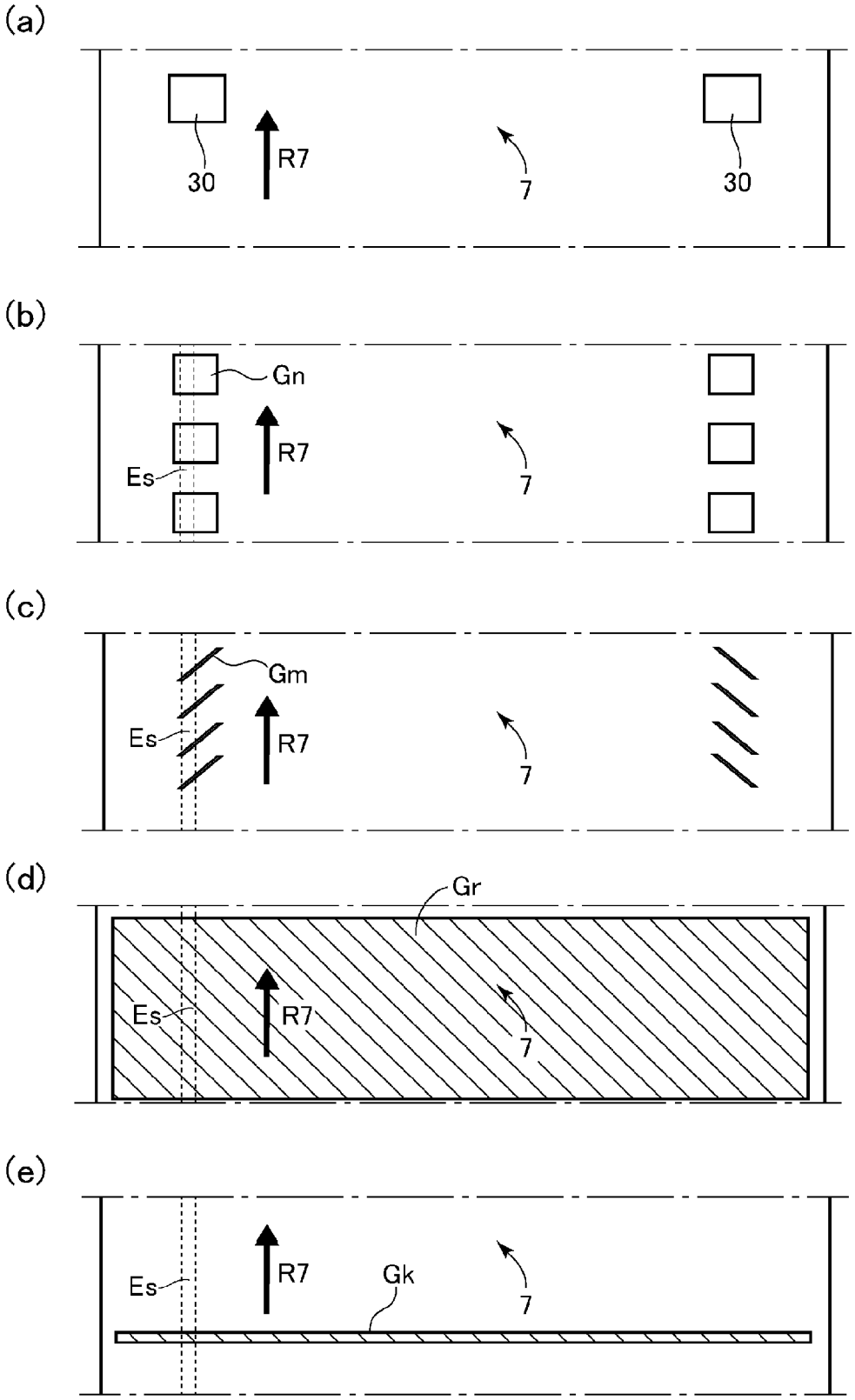
In FIG. 4, (a) to (e) are illustrations of adjusting toner images.

In FIG. 4, (a) to (e) are illustrations of adjusting toner images (toner image for adjustment). In FIG. 4, (a) is an arrangement view of an optical sensor, (b) shows a density adjusting toner image, (c) shows a color misregistration adjusting toner image, (d) shows a deterioration suppressing toner image, and (e) shows a supplying toner image (toner image for supply).

As shown in FIG. 1, in the image forming apparatus 100, in addition to the toner images for the images to be transferred onto the recording material S, various adjusting toner images are formed on the photosensitive drums 1*a*, 1*b*, 1*c*, 1*d* are then are transferred onto the intermediary transfer belt 7. These adjusting toner images are intended to be not transferred onto the recording material S, and therefore are caused to pass through the secondary transfer portion N2 as they are under application of the voltage of the same polarity as the toner charge polarity to the outer secondary transfer roller 14, and then are collected by the belt cleaning device 17.

As shown in FIG. 1, the optical sensor 30 includes an LED which irradiates the intermediary transfer belt 7 with infrared light, and a photo-diode detects specularly reflected infrared light. As shown in (a) of FIG. 4, two optical sensors 30 are disposed at spaced positions with respect to a widthwise direction of the intermediary transfer belt 7 perpendicular to a rotational direction of the intermediary transfer belt 7. The toner deposited on the intermediary transfer belt 7 scatters the infrared light, and therefore the specularly reflected infrared light detected by the optical sensors 30 is smaller with a larger toner amount per unit area of the toner images on the intermediary transfer belt 7. The controller 110 causes the adjusting toner images, formed under a predetermined condition, to be transferred onto the intermediary transfer belt 7, so that the adjusting toner images are detected by the optical sensors 30.

(Density Adjusting Toner Image)

As shown in (b) of FIG. 4, a density adjusting toner image Gn is formed on the photosensitive drum 1*a* so as to pass through the optical sensor 30 and is transferred onto the intermediary transfer belt 7. The density adjusting toner image Gn has a size of 8 mm square, and 8 density adjusting toner images Gn are arranged in a single image interval with an interval of 10 mm while changing the density to 8 levels. The density is changed by changing an areal ratio. Each of the density levels were set so that a proportion (areal ratio) of a toner deposition area was 12.5%, 25%, 37.5%, 50%, 62.5%, 75%, 87.5% and 100% when the density level of a whole area toner deposition image (solid image) was taken as 100%.

The density adjusting toner images Gn formed on the intermediary transfer belt 7 are detected by the optical sensors 30. The controller 110 converts a detection signal of the density adjusting toner images Gn for yellow into a toner amount per unit area by making reference to a density conversion table stored in a non-volatile memory 8*m* of the process cartridge 8*a*.

The controller 110 forms the density adjusting toner images Gn during actuation of the image forming apparatus 100, and then adjusts an image forming condition such as an exposure condition or a developing condition.

(Color Misregistration Adjusting Toner Image)

As shown in (c) of FIG. 4, a color misregistration adjusting toner image Gm is formed on the photosensitive drum 1*a* so as to pass through the optical sensor 30 and is transferred onto the intermediary transfer belt 7. With respect to color misregistration adjusting toner images Gm, 8 adjusting toner images Gm are arranged in a single image interval on each of both sides of the intermediary transfer belt 7 so that on each side, 4 adjusting toner images Gm are disposed in the order of those for yellow, magenta, cyan, black (i.e., the 8 adjusting toner images Gm in total on both sides).

The color misregistration adjusting toner images Gm are used for detecting an amount of color misregistration of the toner images for the respective colors with respect to the widthwise direction (main scan direction of the exposure device 3*a*) perpendicular to the rotational direction (sub-scan direction of the exposure device 3) of the intermediary transfer belt 7. Each of the color misregistration adjusting toner images Gm is formed in an elongated parallelogram in outer configuration, and is 10 mm in length and 1 mm in width.

The controller 110 forms the color misregistration adjusting toner images Gm for each of the colors of yellow, magenta, cyan, black during the actuation of the image forming apparatus 100, and then adjusts an exposure start position with respect to the main scan direction and the sub-scan direction of the exposure device 3*a*.

(Deterioration Suppressing Toner Image)

As shown in FIG. 2, in the developing device 4*a*, the developer is circulated while being stirred, and therefore when image formation of a character image with a small toner consumption amount is continued, a stirring time becomes excessive and thus the toner gradually deteriorates. For that reason, in the image forming apparatus 100, when the image formation with the small toner consumption amount is continued, normal image formation is temporarily interrupted, and then a deterioration suppressing toner image Gr is formed, so that a part of the toner in the developing device 4 is forcedly consumed by the photosensitive drum 1*a*.

Every image formation of a predetermined print number (100 sheets), the controller 110 obtains an insufficient amount of toner consumption in a period of the image formation, and forms the deterioration suppressing toner image in a toner amount corresponding to the insufficient amount of the toner consumption. The insufficient amount of the toner consumption through the period of the continuous image formation is determined by obtaining an integrated density value of image data and then by integrating a difference between the integrated density value and an integrated reference density value (5% of a whole-surface maximum density).

When the integrated value of the difference reaches a value corresponding to a toner consumption amount when a toner image of 100% in areal gradation level (solid image) is formed in an entire image formable region of an A4-sized recording material fed in a long-edge feeding manner, the deterioration suppressing toner image Gr is formed on the photosensitive drum 1*a*. In order to shorten a control time, the deterioration suppressing toner image Gr is formed in a size corresponding to the image formable region of the A4-sized recording material (long-edge feeding).

As shown in (d) of FIG. 4, the deterioration suppressing toner image Gr is transferred onto the intermediary transfer belt 7 and is caused to pass through the secondary transfer portion N2 without being transferred onto the recording material S, and then is removed by the belt cleaning device 17.

(Supplying Toner Image)

In the belt cleaning device 17, it is desirable that at a rubbing portion between the cleaning blade 72 and the intermediary transfer belt 7, the toner in a certain amount exists. For that reason, every when a cumulative print number in the image formation reaches 100 sheets, the controller 110 causes the developing device 4*d* to develop an electrostatic image into a supplying toner image Gk of 1 mm in length with respect to the rotational direction and 290 mm in width with the black toner, and then the supplying toner image Gk is transferred onto the intermediary transfer belt 7. The supplying toner image Gk is formed by the normal image forming process including the charging and the exposure.

(Electrical Cleaning of Adjusting Toner Images)

Figure 6:
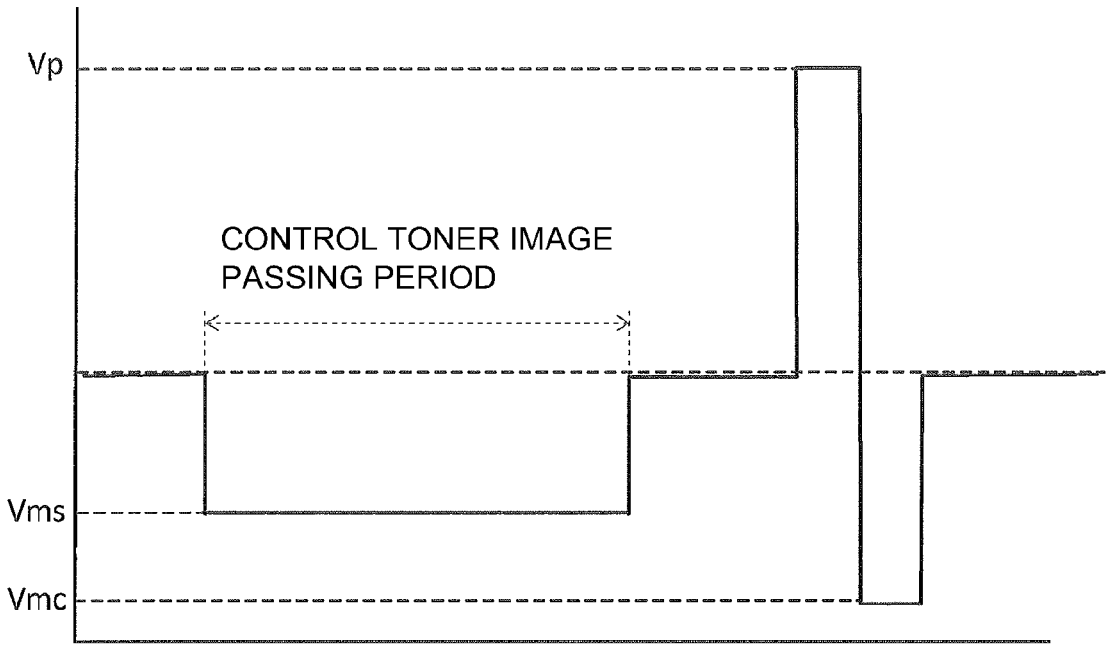
FIG. 6 is an illustration of voltage control of the adjusting toner image.

FIG. 6 is an illustration of voltage control of the adjusting toner images.

As shown in FIG. 3, when the adjusting toner image passes through the secondary transfer portion N2, in order to suppress the transfer of the toner onto the outer secondary transfer roller 14, the voltage source 16 applies the voltage Vms of the same polarity as the toner charge polarity to the outer secondary transfer roller 14. However, when the adjusting toner image passes through the secondary transfer portion N2, the recording material S is not fed, and therefore the adjusting toner image directly contacts the surface of the outer secondary transfer roller 14 in a pressed state. For this reason, even when the voltage Vms of the same polarity as the toner charge polarity is applied to the outer secondary transfer roller 14, a part of the adjusting toner image is deposited on the outer secondary transfer roller 14.

When the voltage Vms is determined, first, a preparatory experiment in which under no voltage application of Vmc, the back surface contamination of the recording material *S can* be prevented at which value of the voltage Vms applied to the outer secondary transfer roller 14 was conducted. That is, a condition under which the back surface contamination can be prevented was obtained by the voltage Vms for preventing the deposition of the negatively charged toner and the voltage Vp for transferring the positively charged toner onto the intermediary transfer belt 7 which are shown in FIG. 6. In this embodiment, Vp=+1500 V.

The intermediary transfer belt 7 on which the deterioration suppressing toner image formed under the most severe condition was carried was caused to pass through the secondary transfer portion N2, and then A4-sized plain paper as the recording material S was caused to pass through the secondary transfer portion N2 where the voltage Vms was applied to the outer secondary transfer roller 14. The deterioration suppressing toner image was 210 mm in length with respect to the feeding direction and was formed after a whole-surface white background image was formed and transferred onto 50 sheets of the recording material S, and immediately thereafter, the whole-surface white background image was formed on one sheet of the recording material S. The recording material S was subjected to evaluation of a generation state of the back surface contamination. The recording material S caused to pass through the secondary transfer portion N2 was heated and pressed by the fixing device 22, and then by visual inspection, whether or not the back surface contamination was generated on the recording material S was checked. The experiment was similarly conducted while changing the voltage Vms from −400 V to −1000 V in 200 V increments.

TABLE 2

| | Vms (V) | | | |
|---|---|---|---|---|
| | −400 | −600 | −800 | −1000 |
| BSCL*1 | X | Δ | ◎ | ◎ |

*1"BSCL" is the back surface contamination level.

As shown in Table 2, when an absolute value of the voltage Vms applied to the outer secondary transfer roller 14 was 800 V or more when the deterioration suppressing toner image passed through the secondary transfer portion N2, the back surface contamination was not generated on the recording material S. Conversely, when the absolute value of the voltage Vms applied to the outer secondary transfer roller 14 is 600 V or less, the negatively charged toner was deposited on the outer secondary transfer roller 14 and thus the back surface contamination was generated on the recording material S.

However, on the basis of an experimental result of Table 2, when the image forming apparatus 100 was operated at the voltage Vms of −1000 V and the voltage Vmc of −1000 V which are shown in FIG. 6, it was turned out that end portion contamination in which the toner was deposited on the recording material S at a leading end portion was generated. It was also turned out that the end portion contamination was generated on the recording material S subjected to the image formation immediately after the adjusting toner image was formed. The end portion contamination of the recording material S was generated with respect to any one of the density adjusting toner image, the color misregistration adjusting toner image, the deterioration suppressing toner image and the supplying toner image, and it was confirmed that a degree thereof was conspicuous with respect to the deterioration suppressing toner image.

As shown in FIG. 3, the end portion contamination of the recording material S generates due to the deposition of the toner on the recording material guide 24. The recording material guide 24 has a plate shape of 20 mm in length with respect to the feeding direction and 400 mm in width, and guides the recording material S passed through the secondary transfer portion N2 to the fixing device 22. Then, it would be considered that a part of the toner is scattered by centrifugal force and is deposited on the recording material guide 24 when the adjusting toner image which passed through the secondary transfer portion N2 without being transferred onto the recording material S and which remains on the intermediary transfer belt 7 rotates along a curve of the outer secondary transfer roller 14.

Therefore, in Embodiment 1, as described later, it was empirically confirmed that when the voltage Vmc was lowered to −400 V or to −600 V, the end portion contamination of the recording material S was eliminated.

However, when the voltage Vms was lowered to −400 V or to −600 V, as shown in Table 2, the toner for the adjusting toner image is considerably deposited on the outer secondary transfer roller 14. For that reason, after the adjusting toner image passes through the secondary transfer portion N2, the voltage Vmc for cleaning is applied to the outer secondary transfer roller 14, so that the toner deposited on the outer secondary transfer roller 14 is collected by the intermediary transfer belt 7.

(Electrical Cleaning)

As shown in FIG. 1, the adjusting toner image is not transferred onto the recording material S, and is collected by the belt cleaning device 17 after being passed through the secondary transfer portion N2.

As shown in FIG. 6, during the passing of the adjusting toner image through the secondary transfer portion N2, in order to alleviate a degree of the transfer of the toner onto the outer secondary transfer roller 14, the voltage Vms of the same polarity as the toner charge polarity is applied to the outer secondary transfer roller 14. After the adjusting toner image passes through the secondary transfer portion N2, similarly as during the image formation, the cleaning voltage Vp=+1500V and the voltage Vmc=−1000V are applied to the uter secondary transfer roller 14.

In this embodiment, the voltage Vms applied to the outer secondary transfer roller 14 when the adjusting toner image passes through the secondary transfer portion N2, was set at a value lower than the cleaning voltage Vmc. As described above, in place of priority of avoidance of toner scattering, the transfer of the part of the negatively charged toner onto the outer secondary transfer roller 14 is allowed when the adjusting toner image passes through the secondary transfer portion N2. Then, after the adjusting toner image passes through the secondary transfer portion N2, the voltage Vmc larger in absolute value than the voltage Vms is applied to the outer secondary transfer roller 14 through one full turn or more, so that the outer secondary transfer roller 14 is cleaned.

(Experiment)

As described above, while changing the voltage Vms from 0 V to 1000 V in absolute value, the experiment in which the deterioration suppressing toner image was caused to pass through the secondary transfer portion N2 was conducted.

The deterioration suppressing toner image was 210 mm in length with respect to the feeding direction and was formed after a whole-surface white background image was formed and transferred onto 50 sheets of the recording material S, and immediately thereafter, the whole-surface white background image was formed on one sheet of the recording material S. The recording material S was subjected to evaluation of a generation state of the back surface contamination. The voltage Vms was changed from 0 V to −1000 V at 6 levels, and a back surface contamination level and an end portion contamination level of the recording material S were evaluated.

TABLE 3

| | Vms (V) | | | | | |
|---|---|---|---|---|---|---|
| | 0 | −200 | −400 | −600 | −800 | −1000 |
| BSCL*1 | X | X | ◎ | ◎ | ◎ | ◎ |
| EPCL*2 | ◎ | ◎ | ◎ | ◎ | X | X |

*1"BSCL" is the back surface contamination level.
*2"EPCL" is the end portion contamination level.

As shown in Table 3, in setting of voltage Vms=voltage Vmc=−1000 V, the back surface contamination level was good, but the end portion contamination level exceeded an allowable range. This is because as described above, a part of the toner for the deterioration suppressing toner image on the intermediary transfer belt 7 passed through the secondary transfer portion N2 is scattered by the centrigural force and thus a feeding path at a periphery of the secondary transfer portion N2 is contaminated with the toner for the deterioration suppressing toner image. The toner scattered and deposited on the recording material guide 24 is scraped off by a leading edge surface of the recording material S, so that the end portion contamination becomes obvious.

When the absolute value of the voltage Vms is gradually made small, the end portion contamination of the recording material S becomes small. When the adjusting toner image passes through the secondary transfer portion N2, if the absolute value of the voltage Vms applied to the outer secondary transfer roller 14 is small, a repelling force to the toner on the intermediary transfer belt 7 is weakened, so that the toner is transferred from the intermediary transfer belt 7 onto the outer secondary transfer roller 14.

It would be considered that the amount of the toner on the intermediary transfer belt 7 decreases by the transfer and thus the toner scattering amount at an entrance of the secondary transfer portion N2. The absolute value of the voltage Vms is a value at which the toner charged to the same polarity as the polarity of the voltage Vms is capable of being deposited on the outer secondary transfer roller 14 when the toner image which is intended to be not transferred onto the recording material S passes through the secondary transfer portion N2.

However, when the absolute value of the voltage Vms is further made small, the contamination of the outer secondary transfer roller 14 becomes conspicuous, so that the back surface contamination level exceeds the allowable range. Therefore, the toner transferred on the outer secondary transfer roller 14 is discharged from the outer secondary transfer roller 14 onto the intermediary transfer belt 7 by electrical cleaning executed after the adjusting toner image passes through the secondary transfer portion N2, so that the back surface contamination of the recording material S is suppressed.

However, as shown in experimental result of Table 3, when the absolute value of the voltage Vms is made 200 V or less, the amount of the toner transferred from the adjusting toner image onto the outer secondary transfer roller 14 became excessive. For that reason, the toner deposited on the outer secondary transfer roller 14 cannot be completely discharged onto the intermediary transfer belt 7 at the cleaning voltage Vmc, so that the back surface contamination of the recording material became conspicuous.

(Setting of Voltage Vms)

In the image forming apparatus 100, as shown in FIG. 5, the controller 110 forms the toner image, to be transferred onto the recording material, on the intermediary transfer belt 7 and then transfers the toner image onto the recording material by causing the voltage source 16 to output the voltage Vt which is an example of the first voltage when the toner image passes through the secondary transfer portion N2. Further, as shown in FIG. 6, the controller 110 cleans the outer secondary transfer roller 14 by causing the voltage source 16 to output the voltage Vmc of the opposite polarity to the polarity of the first voltage through one full turn or more of the outer secondary transfer roller 14 when the toner image does not pass through the secondary transfer portion N2.

In Embodiment 1, the controller 110 forms the toner image, which is intended to be not transferred onto the recording material, on the intermediary transfer belt 7 and then causes the voltage source 16 to output the voltage Vms which has the same polarity as the polarity of the voltage Vt and which has an absolute value smaller than the absolute value of the voltage Vmc when the toner image passes through the secondary transfer portion N2. Specifically, the voltage Vms applied to the outer secondary transfer roller 14 when the deterioration suppressing toner image passes through the secondary transfer portion N2 was set at −500 V smaller in absolute value than the voltage Vmc used for cleaning the outer secondary transfer roller 14 after the image formation as shown in FIG. 5. Further, after the toner image which is intended to be not transferred onto the recording material passes through the secondary transfer portion N2, in order to clean the outer secondary transfer roller 14, the controller 110 causes the voltage source 16 to output the voltage Vp of the same polarity as the polarity of the voltage Vt through one full turn or more of the outer secondary transfer roller 14 and causes the voltage source 16 to output the voltage Vmc which has the same polarity as the polarity of the voltage Vms and which has the absolute value larger than the absolute value of the voltage Vms through one full turn or more of the outer secondary transfer roller 14.

As a result, in Embodiment 1, without generating the back surface contamination of the recording material S, the end portion contamination of the recording material S after the formation of the deterioration suppressing toner image was able to be eliminated. The contamination of the feeding path of the recording material S with the toner was suppressed while maintaining a good cleaning performance for the outer secondary transfer roller 14, so that a good output image was able to be obtained. It became possible to obtain the good output image at an allowable level with respect to not only the back surface contamination but also the end portion contamination.

Embodiment 2

In Embodiment 2, the voltage Vms applied to the outer secondary transfer roller 14 when the adjusting toner image other than the deterioration suppressing toner image passes through the secondary transfer portion N2 is set. The absolute value of the adjusting toner image is made different depending on the species of the adjusting toner image.

(Experimental Result)

The experiment described in the control in Embodiment 1 was conducted for each of the adjusting toner images other than the deterioration suppressing toner image, and an optimum voltage Vms for each of the adjusting toner images was set.

TABLE 4

| | Vms | | | | | |
|---|---|---|---|---|---|---|
| | 0 | −200 | −400 | −600 | −800 | −1000 |
| BSCL*1 | X | X | ◎ | ◎ | ◎ | ◎ |
| ESCL*2 (DS) | ◎ | ◎ | ◎ | ◎ | X | X |
| ESCL*2 (DA) | ◎ | ◎ | ◎ | ◎ | ◎ | X |
| ESCL*2 (CMA) | ◎ | ◎ | ◎ | ◎ | ◎ | X |
| ESCL*2 (S) | ◎ | ◎ | ◎ | ◎ | ◎ | X |

*1"BSCL" is the back surface contamination level.

*2"EPCL" is the end portion contamination level. "(DS)" is for deterioration suppression, "(DA)" is for density adjustment, "(CMA)" is for color misregistration adjustment, and "(S)" is for supply.

As shown in Table 4, also with respect to the density adjusting toner image, the color misregistration adjusting toner image and the supplying toner image, a setting of Vms=Vmc=−1000 V, the end portion contamination exceeded the allowable range.

However, at the voltage Vms=−800 V where the end portion contamination level of the deterioration suppressing toner image exceeds the allowable range, the end portion contamination level of each of the density adjusting toner image, the color misregistration adjusting toner image and the supplying toner image fallen within the allowable range. Therefore, with respect to the density adjusting toner image, the color misregistration adjusting toner image and the supplying toner image, setting of the voltage Vms=−800 V was made.

On the basis of the experimental results of Tables 3 and 4, in Embodiment 2, the voltage Vms applied to the outer secondary transfer roller 14 when the adjusting toner images passed through the secondary transfer portion N2 was changed every species of the adjusting toner images. Table 5 is a list of the voltages Vmc and Vms every species of the adjusting toner images.

TABLE 5

| SPECIES OF ADJUSTING TONER IMAGE | | | | |
|---|---|---|---|---|
| | DC*1 | CMA*2 | DS*3 | STB*4 |
| RCL*5 [mm] | 64 | 8 | 210 | 2 |
| RTS*6 [%] | 45 | 30 | 100 | 2.5 |
| TAPUA*7 [mg/cm2] | 0.6 | 0.4 | 20 | 0.05 |
| Vms [V] | −800 | −800 | −500 | −800 |
| Vmc [V] | −1000 | −1000 | −1000 | −1000 |

*1"DC" is for the density control.

*2"CMA" is for the color misregistration adjustment.

*3"DS" is for the deterioration suppression.

*4"STB" is for supply to the blade.

*5"RCL" is the representative cumulative length.

*6"RTS" is the representative toner share.

*7"TAPUA" is the toner amount per unit area.

As shown in Table 5, the voltage Vms for the deterioration suppressing toner image was set at −500 V which is the same as that in Embodiment 1. With respect to other adjusting toner images, the voltage Vms was set at −800 V. In this way, by setting the voltage Vms depending on the species of the toner images which are intended to be not transferred onto the recording material, the deposition amount of the toner on the outer secondary transfer roller 14 is reduced using the voltage Vms large in absolute value to the possible extent while suppressing the toner scattering after passing of the toner images through the secondary transfer portion N2. This is because even in the case where there is no problem of the back surface contamination of the recording material S in a short period, when the part of the toner deposited on the outer secondary transfer roller 14 is continuously accumulated on the outer secondary transfer roller 14, an exchange lifetime of the outer secondary transfer roller 14 is impaired.

(Plurality of Species of Toner Images)

As shown in FIG. 1, the image forming portions Pa, Pb, Pc, Pd are capable of forming a plurality of species of the adjusting toner images. As shown in Table 5, the controller 110 controls the absolute value of the voltage Vms outputted for at least one species of the toner image of the plurality of species of the adjusting toner images so that the absolute value is smaller than the absolute value of the voltage Vms outputted for the toner image of another species.

That is, as shown in (d) of FIG. 4, the deterioration suppressing toner image Gr which is an example of a first toner image is formed in a region corresponding to an entirety of an image formable region of the A4-sized recording material (long edge feeding). The deterioration suppressing toner image Gn which is an example of a second toner image is formed in a region corresponding to a part of the image formable region of the A4-sized recording material (long edge feeding). As shown in Table 5, the controller 110 controls the absolute value of the voltage outputted when the deterioration suppressing toner image Gr passes through the secondary transfer portion N2 so as to be smaller than the absolute value of the voltage outputted when the deterioration suppressing toner image Gn passes through the secondary transfer portion N2.

(Representative Cumulative Length)

The toner causing the end portion contamination generates from the toner image, which is intended to be not transferred onto the recording material, formed at a single interval (sheet interval) between the toner images to be transferred onto the recording material or in a period (during the post-rotation) after the formation of the toner image to be transferred onto the recording material. For this reason, by comparing "a cumulative value of a length of the toner image which is intended to be not transferred onto the recording material" passes through the secondary transfer portion N2 in these periods, the toner scattering amount in these periods can be estimated. Further, even when a total amount of the toner scattered at the secondary transfer portion N2 in a period in which the controlled adjusting toner image passes through the secondary transfer portion N2 is small, in the case where the adjusting toner image is concentratedly formed at a part with respect to the widthwise direction, a partial toner scattering amount increases. Rather, compared with the case where the toner is deposited on the recording material guide 24 in a dispersed state to a whole area of the recording material guide 24, when the toner is deposited concentratedly at the part with respect to the widthwise direction, the end portion contamination of the recording material is conspicuous.

For that reason, of a plurality of ranges obtained by dividing a widthwise length of the intermediary transfer belt 7 by a unit length with respect to the widthwise direction perpendicular to the rotational direction of the intermediary transfer belt 7, in a range in which a cumulative value of a length of the toner image formed along the rotational direction is largest is defined as a "representative cumulative length" thereof. In the case of the density adjusting toner image and the color misregistration adjusting toner image which are intermittently formed at the same position with respect to the widthwise direction of the intermediary transfer belt 7, the representative cumulative length is a cumulative value of lengths of the toner images from the first toner image to the last toner image with respect to the rotational direction of the intermediary transfer belt 7.

In this case, in the case where the toner scattering amount becomes large in the widthwise range in which the representative cumulative length is obtained, the controller 110 decreases the absolute value of the voltage Vms, and thus decreases the toner scattering amount. That is, when the representative cumulative length of the toner image which is intended to be not transferred onto the recording material is a first value, the controller 110 makes the absolute value of the voltage Vms smaller than that at a second value smaller than the first value. This is because a total amount of the scattered toners from the first toner image and the last toner image which are formed at a single image interval increases with an increasing representative cumulative length, and thus the end portion contamination is liable to generate.

Specifically, as shown in Table 5, the voltage Vms for the deterioration suppressing toner image largest in representative cumulative length is set at −500 V lower than those for other toner images. This is because with an increasing representative cumulative length, the end portion contamination level of the recording material S becomes higher by the image formation after the formation of the toner image which is intended to be not transferred onto the recording material S.

In the case where the density adjusting toner images shown in (b) of FIG. 4 are formed in such a manner that 8 density adjusting toner images for each of the colors of yellow, magenta, cyan, black are arranged in the listed order to form 32 density adjusting toner images in total, the representative cumulative length of the toner images is 256 mm which is not less than 210 mm of the deterioration suppressing toner image. For this reason, the voltage Vms is made smaller in absolute value than −500 V used for the deterioration suppressing toner image.

(Representative Toner Share)

As a parameter for evaluating the toner image cumulative length such as the representative cumulative length, a toner share may also be used. A share ratio of the toner image with respect to a length of the recording material S (A4 size, long edge feeding) having a predetermined size in a range in which the toner image which is intended to be not transferred onto the recording material S is divided by a unit length with respect to the widthwise direction perpendicular to the rotational direction of the outer secondary transfer roller 14 is defined as a toner share. The toner share in a range, of a plurality of ranges, in which the toner share is largest is defined as a "representative toner share". As shown in Table 5, when the representative toner share of the toner image which is intended to be not transferred onto the recording material is a first ratio, the controller 110 controls the absolute value of the voltage Vms so as to be smaller than that at a second ratio lower than the first ratio as the representative toner share.

(Toner Amount Per Unit Area)

A thin toner image is larger in toner amount per unit area than a thick toner image with respect to the toner scattered when the toner image passes through the secondary transfer portion N2. That is, the amount per unit area of the toner scattered at the secondary transfer portion N2 is larger with an increasing toner amount per unit area (toner coverage) of the toner image which is intended to be not transferred onto the recording material S.

Therefore, when the toner amount per unit area of the toner image which is intended to be not transferred onto the recording material S is a first value, the controller 110 controls the absolute value of the voltage Vms so as to be smaller than that when the toner amount per unit area is a second value lower than the first value. The absolute value of the voltage Vms may also be set using another parameter. In either case, the absolute value of the voltage Vms is set so as to be small under such a condition that the toner scattering amount at the secondary transfer portion N2 becomes large or that the end portion contamination is liable to become conspicuous.

(Effect of Embodiment 2)

In Embodiment 2, a lowering amount of the voltage Vms is changed only as needed or in accordance with the above-described parameters, so that it becomes possible to achieve an end portion contamination suppressing effect for the recording material S while delaying an advance of the deposition of the toner on the outer secondary transfer roller 14.

Other Embodiments

The constitution of the image forming apparatus according to the present invention is not limited to the specific constitutions described in Embodiments 1 and 2. The present invention can be carried out also when a part or all of the constitutions described in Embodiments 1 and 2 are replaced with alternative constitutions. The image bearing member may also be the photosensitive drum. That is, the present invention can be carried out also in an image forming apparatus in which the toner image is directly transferred from the photosensitive drum onto the recording material S. A member to which the voltage source outputs the transfer voltage is not limited to the outer secondary transfer roller 14, but may also be a recording material feeding belt (transfer belt). The outer secondary transfer roller 14 may also be connected with the ground potential, and the transfer voltage may also be outputted to the inner secondary transfer roller 13.

In Embodiments 1 and 2, the deterioration suppressing toner image Gr was formed by the normal image forming process including the charging and the exposure, but may also be formed without using the exposure device 3*a*. For example, the absolute value of the DC voltage of the oscillating voltage applied to the charging roller 2*a* is temporarily lowered, and a potential region lower in absolute value than the DC voltage Vdc of the oscillating voltage for the developing device 4*a* is formed on the photosensitive drum 1*a*, and then the electrostatic image for the deterioration suppressing toner image is developed in the potential region by the developing device 4*a*. In this case, the deterioration suppressing toner image has a width corresponding to the developing region of the developing device 4*a* and is formed in such a manner that the toner is uniformly deposited in a band-like region having a length corresponding to a distance in which the DC voltage VD is lowered.

In Embodiments 1 and 2, the certain voltage Vms was used irrespective of the toner charge amount. However, the scattering amount of the toner after passing through the secondary transfer portion N2 is influenced by the toner charge amount of the toner image on the intermediary transfer belt 7. With a decreasing toner charge amount, there is a tendency to weaken an electrostatic depositing force of the toner on the intermediary transfer belt 7 and thus the toner scattering amount increases. For that reason, in the case where the toner charge amount is large, the voltage Vms applied to the outer secondary transfer roller 14 when the adjusting toner image passes through the secondary transfer portion N2 is made high, so that the amount of the toner deposited on the outer secondary transfer roller 14 may also be decreased. As a method of obtaining the toner charge amount, the charge amount of the toner image may also be directly measured by providing a charge amount sensor or an estimated value depending on a temperature, a humidity or a time from actuation of the developing device may also be used.

The voltage Vms is optimized depending on an environment in which the image forming apparatus is installed, a cumulative number of sheets subjected to image formation or a cumulative image formation time, so that the amount of the toner deposited on the outer secondary transfer roller 14 may also be decreased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-008656 filed on Jan. 20, 2015, which is hereby incorporated by reference herein in its entirety.

What is claimed is:

1. An image forming apparatus comprising:

a movable endless belt;

a toner image forming unit configured to form a toner image on said belt;

a movable transfer member, provided in contact with a surface of said belt, configured to form a transfer portion for transferring the toner image carried on said belt onto the recording material;

a guiding member provided downstream of the transfer portion with respect to a feeding direction of the recording material and capable of guiding the recording material;

a voltage source configured to apply a voltage to said transfer member; and a setting portion configured to set the voltage applied to said transfer member in a period in which a toner image which is to be transferred onto the recording material passes through the transfer portion at a first voltage and configured to set the voltage applied to said transfer member in a period in which a predetermined toner image which is not to be transferred onto the recording material passes through the transfer portion at a second voltage of an opposite polarity to a polarity of the first voltage, wherein an absolute value of the second voltage is a first predetermined value when the predetermined toner image is a first predetermined toner image and is a second predetermined value smaller than the first predetermined value when the predetermined toner image is a second predetermined toner image, and a toner amount per unit area of the second predetermined toner image is larger than a toner amount per unit area of the first predetermined toner image.

2. An image forming apparatus according to claim 1, wherein said setting portion sets the voltage applied to said transfer member to a third voltage which has the same polarity as the polarity of the second voltage and which is larger in absolute value than the second voltage in a period after passing of the predetermined toner image through the transfer portion before a subsequent toner image which is to be transferred onto the recording material reaches the transfer portion.

3. An image forming apparatus according to claim 2, wherein said setting portion sets the third voltage in a period in which said transfer member moves through at least one full circumference.

4. An image forming apparatus according to claim 2, wherein said image forming unit includes a developing device, and wherein the first predetermined toner image is a deterioration suppressing toner image formed for suppressing a deterioration of a toner in said developing device.

5. An image forming apparatus according to claim 1, wherein said toner image forming unit includes a developing device, and wherein the first predetermined toner image is a deterioration suppressing toner image formed for suppressing a deterioration of a toner in said developing device.

6. An image forming apparatus according to claim 1, wherein the second predetermined toner image is a density adjusting toner image for adjusting a density of the toner image for the image, and wherein said image forming apparatus further comprises a detecting member configured to detect the density adjusting toner image on said belt and an adjusting portion configured to adjust the density of the toner image for the image on the basis of a detection result of said detecting member.

7. An image forming apparatus according to claim 1, wherein the second predetermined toner image is a position deviation adjusting toner image for adjusting a position of the toner images formed on said belt, and wherein said image forming unit includes a plurality of image forming portions configured to form a plurality of toner images, a detecting member configured to detect the position deviation adjusting toner image on said belt, and an adjusting portion configured to adjust positions of the toner images formed on said belt at said plurality of image forming portions on the basis of a detection result of said detecting member.

8. An image forming apparatus according to claim 1, further comprising a cleaning device including a cleaning blade which is provided in contact with said belt at a position downstream of the transfer portion and upstream of said image forming unit with respect to the movement direction of said belt, for removing a toner on said belt, wherein the second predetermined toner image is a supplying toner image for supplying the toner to said cleaning blade.

9. An image forming apparatus comprising:

a movable endless belt;

a toner image forming unit configured to form toner image on said belt;

a movable outer transfer member, provided in contact with an outer surface of said belt, configured to form a transfer portion for transferring the toner image carried on said belt onto the recording material;

a movable inner transfer member, provided in contact with an inner surface of said belt, configured to oppose said movable outer transfer member through said belt;

a voltage source configured to apply a voltage to said movable inner transfer member; and a setting portion configured to set the voltage applied to said inner transfer member in a period in which a toner image which is to be transferred onto a recording material passes through the transfer portion at a first voltage and configured to set the voltage applied to said inner transfer member in a period in which a predetermined toner image which is not to be transferred onto a recording material passes through the transfer portion at a second voltage of an opposite polarity to a polarity of the first voltage, wherein an absolute value of the second voltage is a first predetermined value when the predetermined toner image is a first predetermined toner image and is a second predetermined value smaller than the first predetermined value when the predetermined toner image is a second predetermined toner image, and a toner amount per unit area of the second predetermined toner image is larger than a toner amount per unit area of the first predetermined toner image.

10. An image forming apparatus comprising:

a movable endless belt;

a toner image forming unit configured to form a toner image on said belt;

a movable transfer member, provided in contact with a surface of said belt, configured to form a transfer portion for transferring the toner image carried on said belt onto the recording material;

a guiding member provided downstream of the transfer portion with respect to a feeding direction of the recording material and capable of guiding the recording material;

a voltage source configured to apply a voltage to said transfer member;

a control portion configured to control the voltage applied to said transfer member, wherein the control portion is configured to apply a first voltage to said transfer member in a period in which a toner image which is to be transferred onto the recording material passes through the transfer portion and is configured to apply a second voltage which has the opposite polarity as the polarity of the first voltage to said transfer member in a period in which a predetermined toner image which is not to be transferred onto the recording material passes through the transfer portion; and a cleaning blade configured to remove toner on said belt;

wherein the control portion is configured to set an absolute value of the second voltage at a first predetermined value when the predetermined toner image is a toner image for being supplied to said cleaning blade and is configured to set an absolute value of the second voltage at a second predetermined value smaller than the first predetermined value when the predetermined toner image is a deterioration suppression toner image formed on the basis of an image ratio.

11. An image forming apparatus comprising:

a moveable endless belt;

a toner image forming unit configured to form a toner image on said belt;

a moveable transfer member, provided in contact with a surface of said belt, configured to form a transfer portion for transferring the toner image carried on said belt onto the recording material;

a guiding member provided downstream of the transfer portion with respect to a feeding direction of the recording material and capable of guiding the recording material;

a voltage source configured to apply a voltage to said transfer member;

a control portion configured to control the voltage applied to said transfer member, wherein the control portion is configured to apply a first voltage to said transfer member in a period in which a toner image which is to be transferred onto the recording material passes through the transfer portion and configured to apply a second voltage which has the opposite polarity as the polarity of the first voltage to said transfer member in a period in which a predetermined toner image which is not to be transferred onto the recording material passes through the transfer portion; and a cleaning blade configured to remove toner on said belt;

wherein the control portion is configured to set an absolute value of the second voltage at a first predetermined value when the predetermined toner image is a toner image for being supplied to said cleaning blade and is configured to set an absolute value of the second voltage at a second predetermined value smaller than the first predetermined value when the predetermined toner image includes a plurality of toner images formed for density control arranged in a circumferential direction, and wherein the toner image for being supplied to said cleaning blade is formed on the basis of a number of sheets subjected to image formation.

12. An image forming apparatus comprising:

a movable endless belt;

a toner image forming unit configured to form a toner image on said belt;

a movable transfer member, provided in contact with a surface of said belt, configured to form a transfer portion for transferring the toner image carried on said belt onto the recording material;

a guiding member provided downstream of the transfer portion with respect to a feeding direction of the recording material and capable of guiding the recording material;

a voltage source configured to apply a voltage to said transfer member;

a control portion configured to control the voltage applied to said transfer member, wherein the control portion is configured to apply a first voltage to said transfer member in a period in which a toner image which is to be transferred onto the recording material passes through the transfer portion and is configured to apply a second voltage which has the opposite polarity as the polarity of the first voltage to said transfer member in a period in which a predetermined toner image which is not to be transferred onto the recording material passes through the transfer portion; and a cleaning blade configured to remove toner on said belt;

wherein during continuous image formation in which images are continuously formed on a plurality of recording materials, the predetermined toner image is formed on said belt at a position corresponding to an interval between a preceding recording material and a recording material following the preceding recording material, and wherein when the predetermined toner image is a first toner image, extended in a stripe shape in a widthwise direction of said belt, for being supplied to said cleaning blade, said control portion sets an absolute value of the second voltage at a first predetermined value, and when the predetermined toner image includes a plurality of second toner images formed for density control arranged in a circumferential direction of said belt, said control portion sets an absolute value of the second voltage at a second predetermined value smaller than the first predetermined value, and wherein a length of the first toner image with respect to the circumferential direction of said belt is shorter than a sum of lengths of the plurality of the second toner images with respect to the circumferential direction of said belt, and wherein toner heights of the second toner images are higher than a toner height of the first toner image.

13. An image forming apparatus comprising:

a movable endless belt;

a toner image forming unit configured to form a toner image on said belt;

a movable transfer member, provided in contact with a surface of said belt, configured to form a transfer portion for transferring the toner image carried on said belt onto the recording material;

a guiding member provided downstream of the transfer portion with respect to a feeding direction of the recording material and capable of guiding the recording material;

a voltage source configured to apply a voltage to said transfer member; and a control portion configured to control the voltage applied to said transfer member, wherein the control portion is configured to apply a first voltage to said transfer member in a period in which a toner image which is to be transferred onto the recording material passes through the transfer portion and is configured to apply a second voltage which has the opposite polarity as the polarity of the first voltage to said transfer member in a period in which a predetermined toner image which is not to be transferred onto the recording material passes through the transfer portion; and wherein when the predetermined toner image is a first toner image extended in a stripe shape in a widthwise direction of said belt, said control portion sets an absolute value of the second voltage at a first predetermined value, and when the predetermined toner image is a second toner image which is extended in a stripe shape in the widthwise direction of said belt and which is longer in length with respect to a rotational direction of said belt than the first toner image, said control portion sets an absolute value of the second voltage at a second predetermined value smaller than the first predetermined value.

14. An image forming apparatus according to claim 13, wherein toner amounts per unit area of the second toner image is larger than a toner amount per unit area of the first toner image.

* * * * *